US006846160B2

(12) United States Patent
Saito et al.

(10) Patent No.: US 6,846,160 B2
(45) Date of Patent: Jan. 25, 2005

(54) TURBINE BUCKET

(75) Inventors: Eiji Saito, Hitachi (JP); Kiyoshi Namura, Tokai (JP); Yutaka Yamashita, Hitachi (JP); Masakazu Takasumi, Juou (JP); Yoshiaki Yamazaki, Hitachi (JP); Yoshio Shikano, Hitachinaka (JP); Kazuo Ikeuchi, Hitachi (JP); Masumi Katayose, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/436,984

(22) Filed: May 14, 2003

(65) Prior Publication Data

US 2003/0228225 A1 Dec. 11, 2003

Related U.S. Application Data

(63) Continuation of application No. 09/958,604, filed as application No. PCT/JP99/05710 on Oct. 15, 1999, now Pat. No. 6,579,066.

(51) Int. Cl.[7] ..... F01D 5/14
(52) U.S. Cl. ..... 416/190
(58) Field of Search ..... 416/190, 500; 415/119

(56) References Cited

U.S. PATENT DOCUMENTS

| | | | | | |
|---|---|---|---|---|---|
| 3,758,233 A | * | 9/1973 | Cross et al. | ..... | 416/500 |
| 4,497,613 A | * | 2/1985 | Carreno | ..... | 416/500 |
| 4,643,645 A | * | 2/1987 | Robbins et al. | ..... | 416/190 |
| 4,919,593 A | * | 4/1990 | Brown | ..... | 416/500 |
| 5,232,344 A | * | 8/1993 | El-Aini | ..... | 416/500 |
| 5,267,834 A | | 12/1993 | Dinh et al. | | |
| 5,286,168 A | | 2/1994 | Smith | | |
| 5,286,169 A | | 2/1994 | Dinh et al. | | |
| 5,299,915 A | | 4/1994 | Dinh et al. | | |
| 5,393,200 A | | 2/1995 | Dinh et al. | | |
| 5,445,498 A | | 8/1995 | Williams et al. | | |

FOREIGN PATENT DOCUMENTS

| | | | | | |
|---|---|---|---|---|---|
| JP | 52029506 A | * | 3/1977 | ..... | F01D/5/22 |
| JP | 4-5402 | | 1/1992 | | |
| JP | 05086802 A | * | 4/1993 | ..... | F01D/5/16 |

* cited by examiner

*Primary Examiner*—Edward K. Look
*Assistant Examiner*—Igor Kershteyn
(74) *Attorney, Agent, or Firm*—Mattingly, Stanger & Malur, P.C.

(57) ABSTRACT

The present invention relates to a turbine bucket to be provided at the low pressure last stage of a steam turbine and an object of the present invention is to provide a turbine bucket in which the adjacent blades are connected without using a connecting member at a blade intermediate portion. In order to achieve the object of the present invention, a turbine bucket of the present invention is formed in such a manner that the blade sectional configuration is twisted from a blade root portion to a blade tip side, and when assuming two axial directions in a blade section of the bucket on horizontal plane and taking one axial direction as X axis and the other axial direction perpendicular to X axis as Y axis, the blade sections at predetermined heights from the blade root portion of the turbine bucket are formed in a range of ±0.3 mm from respective points defining blade section configurations as shown respectively in chart 1, chart 4, chart 7, chart 10, chart 13, chart 16 and chart 18.

1 Claim, 6 Drawing Sheets

TURBINE BUCKET

This is a continuation application of U.S. Ser. No. 0/958,604, filed Oct. 12, 2001. Now U.S. Pat. No. 6,579,066 which is a 371 of PCT/JP99/05710.

FIELD OF THE INVENTION

The present invention relates to a turbine bucket which is provided at the low pressure last stage of a steam turbine.

BACKGROUND ART

A turbine bucket is generally provided for a purpose of properly converting energy contained in thermal fluid into rotation energy. When designing the turbine bucket, it is necessary that the turbine bucket has a strength of withstanding a loading force and a centrifugal force by the thermal fluid and has to satisfy a mechanical characteristic with regard to vibration characteristic which prevents stimuli at the time of rated rotation. Further, in order to converting the thermal fluid energy into the rotation energy it is necessary to satisfy aerodynamic characteristic of reduced energy loss. Accordingly, in order to satisfy both the mechanical characteristic and the aerodynamic characteristic at the same time, it is necessary to overcome mutually contradicting structural requirements.

When there is a problem with regard to strength because of stress concentration at a contain position on a turbine bucket, even if a blade profile having a stream line reflecting fluid flow performance, it is necessary to thicken the blade cross section to increase the blade rigidity. Further, if the vibration characteristic of the blade profile shows stimuli at the time of the rated rotation which has to be avoided, it is also necessary to modify the blade profile. In particular, with regard to a turbine bucket for a steam turbine, if a higher efficiency of the blade performance is seeked, rigidity of individual blades is reduced, therefore, in order to increase rigidity of the blade structure as a whole, a blade connecting structure is employed in which adjacent blades are connected by such as shrouds and tie wires. Since such blade connecting structure disturbs the fluid flow in view of flow performance, the structure is not necessarily optimum as a turbine bucket as a whole.

In order to overcome these problems, it is necessary to determine the blade profile with only one solution for every limiting condition such as a blade length so as to fully satisfy reliability based on the mechanical characteristic as well as the aerodynamic characteristic. For example, U.S. Pat. No. 5,267,834 discloses a structure in which a blade profile satisfying strength, vibration and performance properly when the blade length is about 660 mm is determined, and a cover piece is provided at tips of the blades and a sleeve is provided at intermediate portions of the blades and the adjacent blades are connected by a member connecting the adjacent blades at two positions in the radial direction.

In the above referred to U.S. Pat. No. 5,267,834, it is indicated that for the blade profile and the blade structure when the blade length is about 660 mm through the provision of the blade connecting member at two positions in the radial direction the rigidity of the blade structure as a whole is enhanced. However, the provision of such blade connecting member at two positions in the intermediate portions of the blades disturbs working fluid flow at substantially the intermediate portions between the blades and extremely reduces fluid flow performance representing aerodynamic characteristic at the intermediate portions.

The present invention is carried out in view of the above problems and an object of the present invention is to provide a turbine bucket in which adjacent blades are connected without using the connecting member at the intermediate portions of the blades.

DISCLOSURE OF THE INVENTION

In order to achieve the object of the present invention, a turbine bucket of the present invention is formed in such a manner that the blade sectional configuration is twisted from a blade root portion to a blade tip side, and when assuming two axial directions in a blade section of the bucket on horizontal plane and taking one axial direction as X axis and the other axial direction perpendicular to X axis as Y axis, the blade sections at predetermined heights from the blade root portion of the turbine bucket are formed in a range of ±0.3 mm from respective points defining blade section configurations as shown respectively in chart 1, chart 4, chart 7, chart 10, chart 13, chart 16 and chart 18.

In order to achieve the object of the present invention, a turbine bucket of the present invention is formed in such a manner that the blade sectional configuration is twisted from a blade root portion to a blade tip side, and when assuming two axial directions in a blade section of the bucket on horizontal plane and taking one axial direction as X axis and the other axial direction perpendicular to X axis as Y axis, the blade sections at predetermined heights from the blade root portion of the turbine bucket are formed in a range of ±0.3 mm from respective points defining blade section configurations as shown respectively in chart 19, chart 22, chart 24, chart 9, chart 12, chart 15 and chart 18.

As has been explained above, according to the present invention an advantage can be obtained that a turbine bucket can be provided in which adjacent blades are connected each other without using a connecting member at the blade intermediate portion.

Further, the present invention provides, even with no connecting member at the blade intermediate portion, a turbine bucket which has a mechanical strength withstanding such as large centrifugal force and steam loading force, a vibration characteristic avoiding stimuli at the time of rated rotation and fluid flow performance converting steam energy to rotation every properly with reduced loss.

BEST MODES FOR CARRYING OUT THE INVENTION

Figure 1:
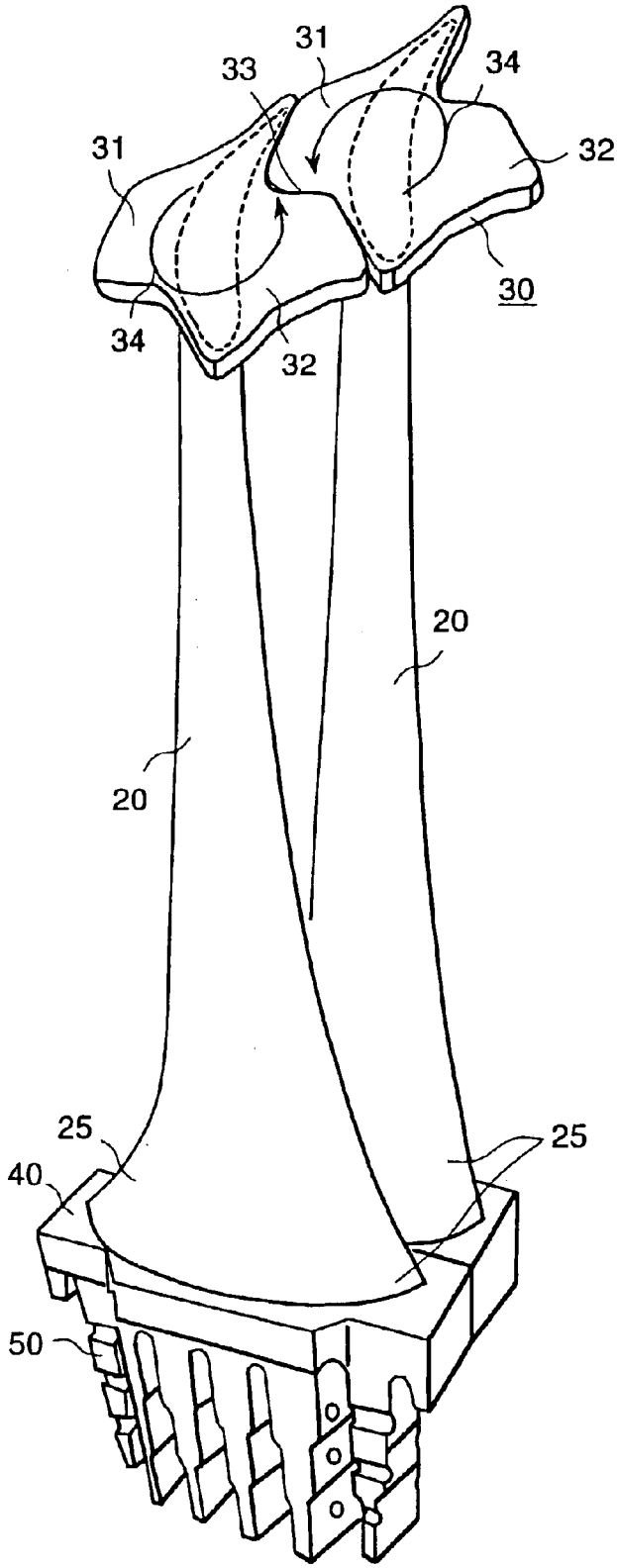
FIG. 1 is an outlook of a turbine bucket showing an embodiment of the present invention.
Figure 2:
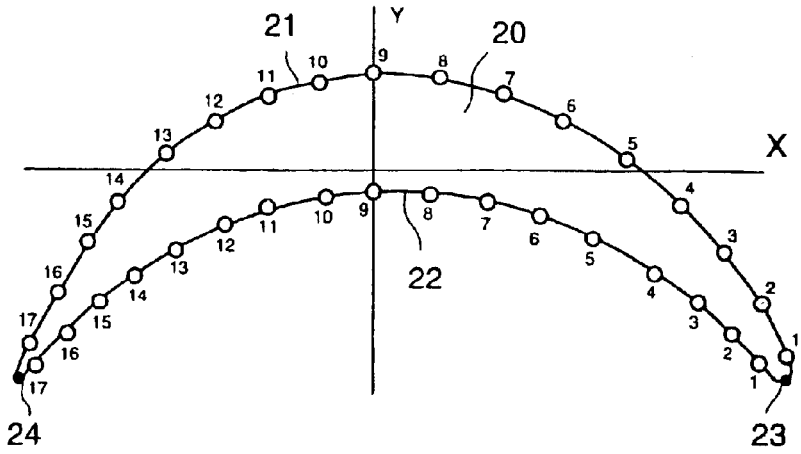
FIG. 2 is a cross sectional view of the turbine bucket as shown in FIG. 1.
Figure 3:
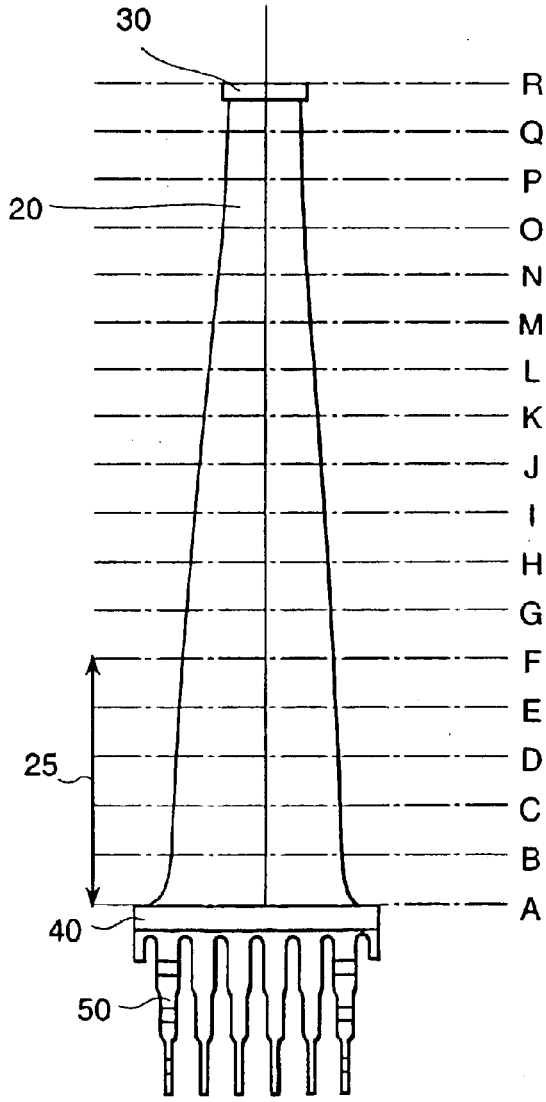
FIG. 3 is another outlook of the turbine bucket showing the embodiment of the present invention.
Figure 4:
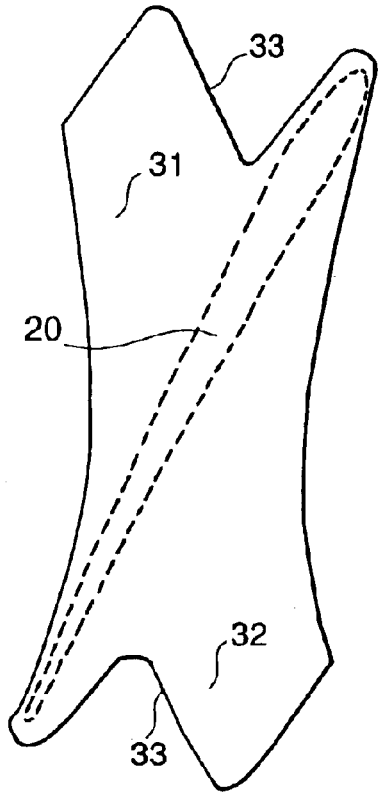
FIG. 4 is an outlook of a shroud showing the embodiment of the present invention.

Hereinbelow, an embodiment of the present invention will be explained in detail with reference to FIGS. 1 through 4. FIG. 1 is an outlook of a turbine bucket showing the embodiment of the present invention, FIG. 2 is a blade profile cross sectional view of the turbine bucket, FIG. 3 is an outlook of the turbine bucket seen from the circumferential direction, and FIG. 4 is an outlook of a cover provided at a blade tip portion of the turbine bucket. Further, in the following explanation, a turbine bucket having a blade length of about 660 mm will be explained.

As shown in FIG. 1, the turbine bucket of the present embodiment is constituted by a blade profile 20, a shroud 30, a platform portion 40 and a blade root portion 50. The blade profile 20 is formed in such a manner that the blade cross section configuration is twisted from the blade root portion to the blade tip side, and at the blade tip portions of the blade profile 20 the shroud 30 which is formed so as to extend respectively toward the back and front sides of the bucket is formed integrally with the blade profile 20. Further, at the blade root portion of the blade profile 20 a blade root portion fillet 25 is provided so as to suppress stress concentration induced at the blade root portion when being connected to the platform portion 40. This is because when connecting the blade profile 20 with the platform portion 40, if there are sharp angle portions, the stress concentration is induced there to thereby reduce the mechanical strength of the bucket. For the same reason, it is preferable to provide a fillet 25 at the connecting portion between the blade profile 20 and the shroud 30. The thus constituted turbine buckets are assembled by successively inserting the respective blade root portions 50 into grooves formed in a turbine rotor not shown.

Further, as has been explained above, at the tip portion of the blade profile the shroud 30 (an integral shroud cover) serving as a cover is formed integral with the blade. The shroud 30 is formed in a pair of a blade back side shroud portion 31 and a blade front side shroud portion 32 and each includes a contacting face contacting to the adjacent shroud as shown in FIG. 4. With the provision of thus configured shroud 30 at the tip portion, a generally well known blade twisting phenomenon is caused during rotation of the turbine bucket and a twisting force in the direction as shown by arrows 34 in FIG. 1 acts on the shroud 30 at the blade tip portion. Therefore, the back side shroud and the front side shroud of the adjacent blades are contacted and connected via the contacting faces. Thereby, when observing the blade structure as a whole, all of the circumferential blades of the turbine bucket are structured to form a single ring at the blade tips, accordingly, in comparison with the blade structure with individual independent blades, the rigidity of the blade structure as a whole is increased and a vibration characteristic with slight stimuli can be achieved.

Further, since the adjacent blades are contacted and connected via the shrouds 30, a damping effect due to the contacting is induced and a blade structure which decreases response to vibration can be realized. Therefore, in comparison with the blade structure with individual independent blades, even in a case of fluid coupled vibration such as buffeting and fluttering due to unsteady fluid, the vibration response is limited by the damping effect due to contacting and connecting by the shrouds, thereby, a safe blade structure can be realized. Further, the thickness of the shroud contributes both for the rigidity and the mass with regard to mechanical property of the turbine bucket, therefore, if the thickness is thick which operates to increase the mass and the centrifugal force thereby, and contrary, if the thickness is thin which tends to weaken the rigidity, thereby, the rigidity by the blade connection can not be expected. For this reason, it is preferable to select an optimum thickness of the shroud of about 4.5 mm–6 mm. Now, an embodiment of the blade root portion of the present invention will be explained.

Figure 7:
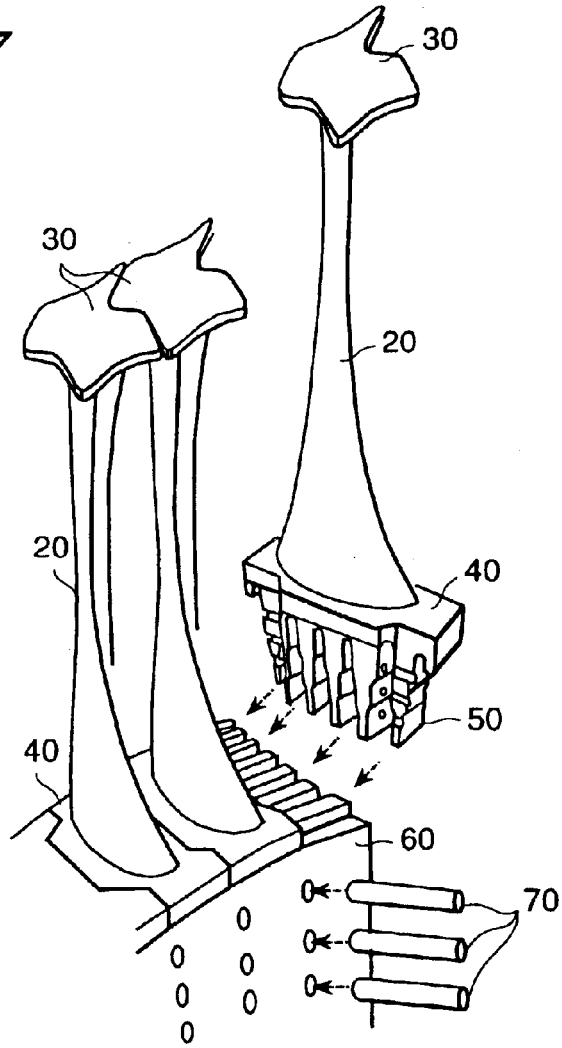
FIG. 7 is a constitution diagram when assembling a turbine bucket.

FIG. 7 shows a schematic diagram when assembling the turbine buckets of the present embodiment to a turbine rotor. The turbine bucket of the present embodiment has a structure of the blade root portion 50 with six fingers as shown in FIG. 7, and it is preferable to be structured in a manner that the turbine rotor portion 60 and the blade root portions 50 are fixed by three pieces of pins 70. This is because if the finger structure as above is employed, in addition to the alternate fitting of the turbine bucket and the turbine rotor portion through the six pieces of fingers, the both are further firmly connected via the three pieces of pins, thereby, the fixing condition at the blade root portions gives a rigid connection, thus, in particular, when the blades vibrate in the circumferential direction, the load can be received at the plane of the planting portion, an advantage of limiting stress concentration can be achieved.

Now, the details of the blade profile of the present embodiment will be explained. As shown in FIG. 3, blade sections which are taken by slicing the turbine bucket extending in radial direction from the blade root portion toward the blade tip side perpendicularly are defined at respective heights from A to R. In this instance, the height of the blade section A at the blade root portion is defined as origin height O in radial direction coordinate Z axis and the heights after the blade section B are ones those measured from the blade section A toward the blade tip. FIG. 2 defines the above explained blade sections by X-Y coordinates. In this instance, it is defined that the unit of the numeral values in the coordinates is mm, axial direction of the turbine bucket is X axis and the circumferential direction of the turbine bucket is Y axis. Further, a blade front edge 23 positions at the positive side of X axis and a blade rear edge 24 positions at the negative side of X axis, and the rotating direction of the turbine bucket coincides with the direction of Y axis. Further, the center coordinate position where respective blade sections such as shown in FIG. 2 are stacked in radial direction coincides with Z axis in the radial direction. In the thus defined X-Y-Z coordinate system, numerals from 1 to 17 from the blade front edge 23 toward the blade rear edge 24 are separately assigned to respective points on a blade back side portion 21 and a blade front side portion 22 as shown in FIG. 2.

The charts 1 through 18 which will be explained later show coordinate values of series of points of the blade profiles at respective heights from the blade section A to the blade section R as shown in FIG. 3. The entity of the blade profiles are formed by connecting the adjacent points in the series of points by a smooth curve. For example, when exemplifying the blade section A, at first the series of points on the blade back side portion of the blade section, in that from point numbers 1 to 17 are connected by smooth curves and likely the series of points from point numbers 1 to 17 on the blade front side portion 22 are connected by smooth curves. At the front edge 23 the series point number 1 on the blade back side portion and the series point number 1 on the blade front side portion 22 are connected by a smooth arc. Likely, at the blade rear edge 24 points of the series point number 17 are connected each other by a smooth curve. With the above process, the blade section A is formed and the like manner the blade sections B through R are formed.

Further, if a manufacturing error of the blade sections formed by connecting the series of points as explained above is within ±0.3 mm, advantages of the present embodiment which will be explained later can be achieved. Further, preferably if the manufacturing error is limited in a range of ±0.15 mm, the performance of the blades can be further enhanced. On the other hand, if the manufacturing error exceeds ±0.3 mm, the performance thereof is deteriorated and an inconvenience of inducing stimuli at the time of rated rotation can be caused.

Further, the respective configurations of the blade sections constituting the blade profiles in the turbine bucket of the present embodiment are respectively constituted in a range within ±0.3 mm of at least the series of points as shown in chart 1, chart 4, chart 7, chart 10, chart 13, chart 16 and chart 18. Preferably, the configuration of the blade sections are respectively constituted according to the series of points as shown in chart 1, chart 3, chart 5, chart 7, chart 9, chart 11, chart 13, chart 15 and chart 17 or preferably according to chart 2, chart 4, chart 6, chart 8, chart 10, chart 12, chart 14, chart 16 and chart 18. The most preferable embodiment is one having the blade profiles constituted according the blade sections as shown in the chart 1 through the chart 18.

Generally, in the turbine bucket a lower order vibration mode is never stimulated at the time of rated rotation and further, the turbine bucket is designed in such a manner that even if a higher order vibration mode is stimulated the stimulation response is limited such as by the high rigidity and the damping effect conventionally, since the individual blades of the turbine bucket having a blade length of about 660 mm shows a low rigidity in comparison with the blades having a shorter blade length, therefore, through provision of the connecting structure at two positions in radial direction the rigidity of the turbine bucket as a whole is increased. Because, if the rigidity is high, the natural frequency is increased, thereby, number of low order vibration modes, stimulation with which is to be avoided, is reduced and a stimulation with higher order vibration modes can be withstood.

On the other hand, when the turbine bucket is formed according to the blade profiles as has been explained above, and the shrouds are provided at the tips thereof, a blade structure, which has a mechanical strength fully withstanding a centrifugal force and a working thermal fluid force acting on the turbine and has a preferable mechanical characteristic with a vibration characteristic in which no stimuli occur under a use condition of a rated rpm of 60 cycles per second, can be realized without providing the connecting members at the intermediate of the turbine blades. Accordingly, a turbine blades preferable with regard to aerodynamic characteristic and desirable performance and with no connecting members at the intermediate portions in the radial direction in the turbine blade structure and with no structural bodies which disturb fluid flow between the blades in the turbine stage can be realized.

Now, the turbine bucket of the present embodiment will be explained with reference to FIGS. 5 and 6.

Figure 5:
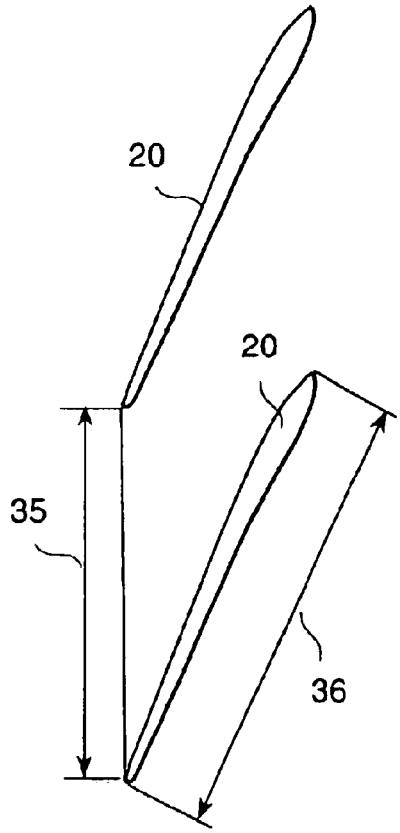
FIG. 5 is a model diagram between blades of the turbine bucket showing the embodiment of the present invention.
Figure 6:
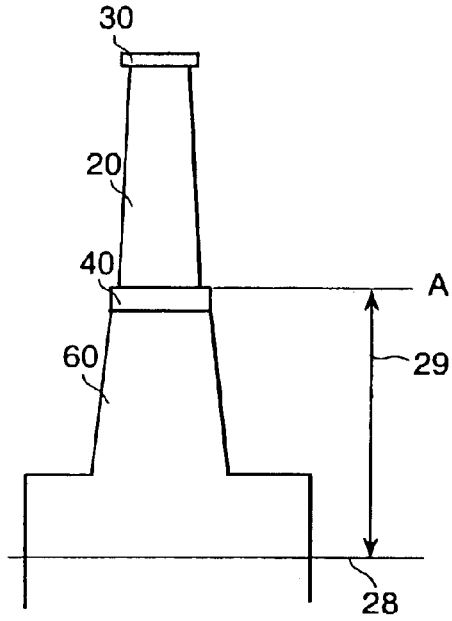
FIG. 6 is a constitution diagram of a turbine.

FIG. 5 shows a cross sectional view of the flow passage between blades at the blade tip portion of the turbine bucket of the present embodiment and FIG. 6 shows a constitutional diagram of a turbine rotor including the turbine bucket of the present embodiment. In FIG. 5, 35 shows a pitch between the blades and 36 shows a code of the blade. Further, in FIG. 6, 28 shows the center of the turbine rotor, 29 a height from the center of the turbine rotor to the blade root cross section of the turbine bucket and 60 a turbine rotor.

A ratio of the inter blade pitch 35 and the blade code 36 as shown in FIG. 5 is known as one of important parameters for evaluating the blade performance. When the ratio of the inter blade pitch and the blade code is too large, the number of blades over the entire circumference is limited and the passage between blades is too broadened to thereby cause separation of working fluid flow. Contrary thereto, when the ratio of the inter blade pitch and the blade code is too small, number of blades over the entire circumferential becomes too many and a large friction at the surfaces of the blades is caused to thereby reduce the performance of the blades. Therefore, there exists an optimum ratio of the inter blade pitch and the blade code for a turbine bucket having certain blade profiles.

In the turbine bucket of the present embodiment having the blade profiles as shown in chart 1 through chart 18, if a ratio between the inter blade pitch and the blade code at the tip thereof in a range of 1.3–1.4 is selected, an optimum blade performance can be achieved. For this purpose, when height 29 from the center of the turbine rotor to the blade root cross section of the turbine bucket as shown in FIG. 6 is about 1168 mm, and if a number of the blades over the entire circumference of 114–120 is selected, an optimum ratio of the inter blade pitch and the blade code can be realized.

Figure 8:
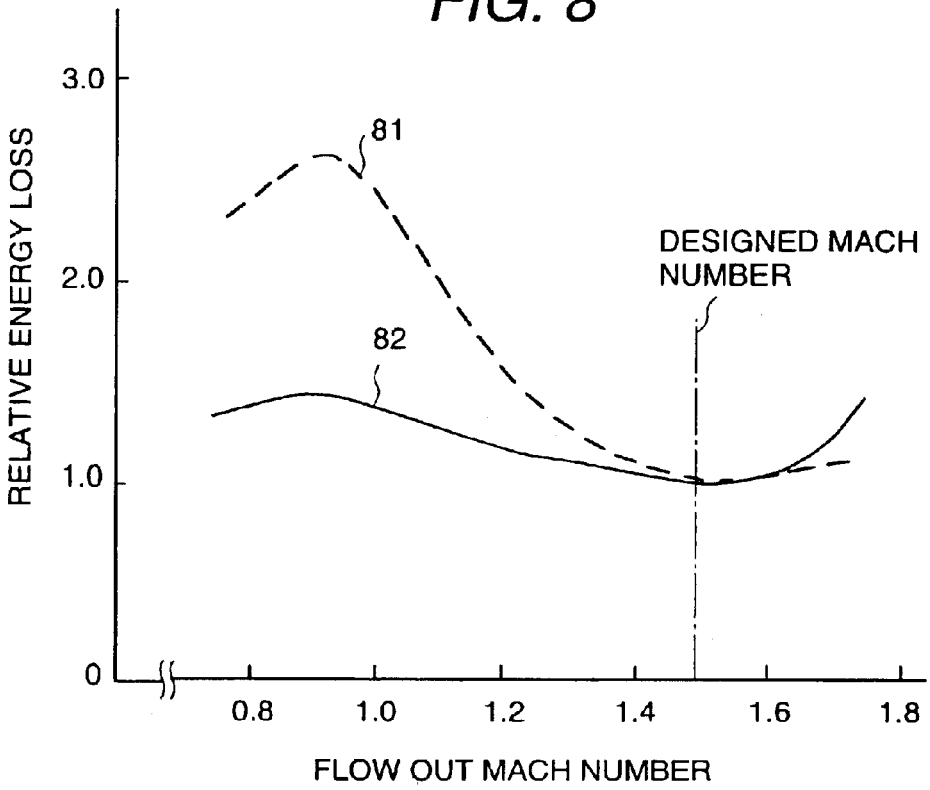
FIG. 8 is a mach number performance characteristic diagram of the turbine bucket showing the embodiment of the present invention.

FIG. 8 is a mach number performance characteristic diagram of the turbine bucket of the present embodiment. Further, FIG. 8 shows a result of the blade profile constituted by the blade sections according to chart 7 through chart 18. Still further, the graph in FIG. 8 shows a comparison between a relative energy loss distribution 82 when assuming the minimum value of kinetic energy loss as 1 and a relative energy loss distribution 81 of a common turbine bucket with respect to flow out mach number.

Generally, when designing performance of a turbine bucket, since the operating condition of a steam turbine used in a usual electric power generation installation is substantially the same, the design is performed based on a commonly used operating condition so that the best performance for the concerned operating condition is realized. However, when an actual operating condition falls outside the concerned operating condition, namely, when the flow out mach number does not reach to the designed mach number, a relative energy loss increases and the performance is frequently deteriorated.

In particular, a steam turbine, in which low pressure last stage a turbine bucket having blade length of about 660 mm is assembled, is not only operated as a single steam turbine but also is frequently operated as in a combined cycle system together with a gas turbine. The performance of a conventional blade structure has no specific problems when used as the single steam turbine, however, when assembled in a combined cycle system, the steam turbine is frequently required to perform a partial load operation, therefore, is not placed under an operating condition of a constant steam pressure, thus the thermal load condition therefor is variable in comparison with when the same is used as a single independent body.

On the other hand, with the turbine bucket having the blade profile of the present embodiment, as shown in FIG. 8 the relative energy loss is minimized at the flow out mach number of the designed mach number to show a desirable performance as well as even before the flow out mach number reaches to the designed mach number which represents at the time of a partial load operation, the relative energy loss is greatly reduced in comparison with the conventional one. Accordingly, the present embodiment can achieve a high performance under a broad range of thermal load condition in comparison with the conventional one.

The reason of the above advantages are that, in the turbine bucket having the profile of the present embodiment, since the blade array flow passage in downstream the throat portion is formed in a divergent flow passage, the velocity of the thermal fluid flowing through the blades can be efficiently transitioned from subsonic to supersonic, and further, the profile of the turbine bucket is formed to have another feature of a straight back blade in which the back side face of the blade downstream the throat portion is formed straight which is well known as a shape suitable for transonic flow of comparatively low mach number.

As has been explained above, the present embodiment achieves an advantage of providing a turbine bucket of which adjacent blades are connected without using connecting members at the intermediate portions of the blades. Further, the present embodiment provides, even with no connecting member at the blade intermediate portion, a turbine bucket which has a mechanical strength withstanding such as large centrifugal force and steam loading force, a vibration characteristic avoiding stimuli at the time of rated rotation and fluid flow performance converting steam energy to rotation every properly with reduced loss.

Further, in the present embodiment, although the turbine bucket having blade length of about 660 mm and the height of about 1168 mm from the turbine rotor center to the blade root cross section of the bucket has been explained, the present embodiment can be applied to a turbine bucket having different size from the present embodiment by forming a blade profile having blade section coordinate point values which are determined by proportionally reducing or expanding the blade section coordinate point values as shown in charts 1 through 18.

Now, another embodiment of the present invention will be explained.

A turbine bucket of the present embodiment is formed in such a manner that the coordinates of the series of points of respective blade sections of the blade profile of 8 sections from the blade section A to the blade section F at respective section heights as shown in FIG. 3 have the coordinates of the series of points as shown in chart 19 through chart 24 which will be explained later and the coordinates of the series of points of respective blade sections of the blade profile of the sections from the blade section G to the blade section R at respective section heights have the coordinates of the series of points as shown in chart 7 through chart 18. Further, the tip portion of the turbine bucket is provided with an integral shroud cover which is formed integrally with the blade as shown in FIG. 4. Still further, the turbine bucket of the present embodiment is intended to be used with a different turbine rotor from that used with the previous turbine bucket. Namely, the present embodiment is preferable as a replacing article in which the blade length of the turbine bucket is about 660 mm and the height 29 from the turbine rotor center to the blade root cross section of the turbine bucket as shown in FIG. 6 is about 1270 mm which is now commonly used.

Like the previous embodiment, with the turbine bucket of the present embodiment, a blade structure which has a mechanical strength fully withstanding a centrifugal force and a working thermal fluid force acting on the turbine and a preferable mechanical characteristic with a vibration characteristic in which no stimuli occur under a use condition of a rated rpm of 60 cycles per second can be realized without providing the connecting members at the intermediate of the turbine blades. Accordingly, a turbine blades preferable with regard to aerodynamic characteristic and desirable performance and with no connecting members at the intermediate portions in the radial direction in the turbine blade structure and with no structural bodies which disturb fluid flow between the blades in the turbine stage can be realized.

Further, with the turbine bucket having the blade profile of the present embodiment, as shown in FIG. 8 the relative energy loss is minimized at the flow out mach number of the designed mach number to show a desirable performance as well as even before the flow out mach number reaches to the designed mach number which represents at the time of a partial load operation, the relative energy loss is greatly reduced in comparison with the conventional one. Accordingly, the present embodiment can achieve a high performance under a broad range of thermal load condition in comparison with the conventional one.

Further, if a manufacturing error of the blade sections formed by connecting the series of points as explained above is within ±0.3 mm, advantages of the present embodiment which will be explained later can be achieved. Further, preferably if the manufacturing error is limited in a range of ±0.15 mm, the performance of the blades can be further enhanced. On the other hand, if the manufacturing error exceeds ±0.3 mm, the performance thereof is deteriorated and an inconvenience of inducing stimuli at the time of rated rotation can be caused.

Further, the respective configurations of the blade sections constituting the blade profiles in the turbine bucket of the present embodiment are respectively constituted in a range within ±0.3 mm of at least the series of points as shown in chart 19, chart 22, chart 24, chart 9, chart 12, chart 15 and chart 18. Preferably, the configuration of the blade sections are respectively constituted according to the series of points as shown in chart 19, chart 21, chart 23, chart 7, chart 9, chart 11, chart 13, chart 15 and chart 17 or preferably according to chart 18, chart 20, chart 22, chart 24, chart 10, chart 12, chart 14, chart 16 and chart 18. The most preferable embodiment is one having the blade profiles constituted according the blade sections as shown in the chart 18 through the chart 24, and the chart 7 through the chart 18.

Like the previous embodiment, if a ratio between the inter blade pitch and the blade code at the tip thereof in a range of 1.3–1.4 is selected, an optimum blade performance can be achieved. For this purpose, when height from the center of the turbine rotor to the blade root cross section of the turbine bucket is about 1270 mm, and if a number of the blades over the entire circumference of 120–127 is selected, an optimum ratio of the inter blade pitch and the blade code can be realized.

Further, if the turbine buckets such as having a blade profile with blade sections defined by the coordinates of series points as shown in chart 1 through chart 18 and having a blade profile with blade sections defined by the coordinates of series of points as shown in chart 19 through chart 24 and chart 7 through chart 18 are proportionally reduced or expanded while keeping the ratio of the inter blade pitch and the blade code in a range of 1.3–1.4, the advantage of the present embodiment can also be appreciated by the modification regardless to the height thereof from the turbine rotor center to the blade root cross section of the turbine bucket.

Now, a modification of a shroud will be explained with reference to FIGS. 9, 10 and 11.

Figure 9:
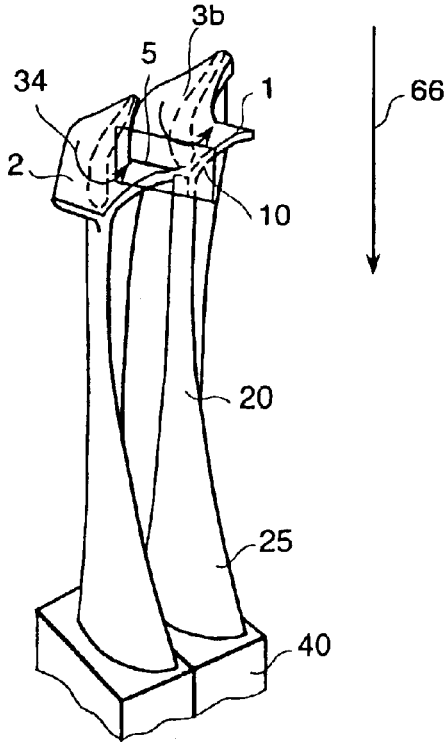
FIG. 9 is an entire constitution diagram of a steam turbine bucket showing another embodiment of the present invention.
Figure 10:
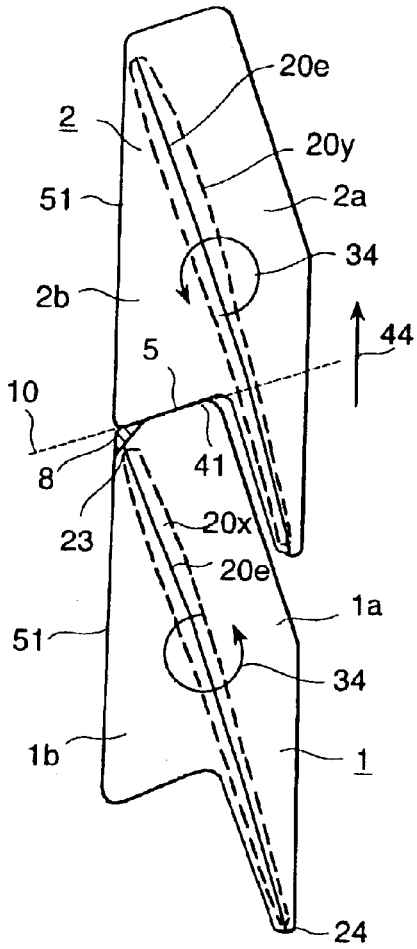
FIG. 10 is a constitution diagram of a shroud of the steam turbine bucket.
Figure 11:
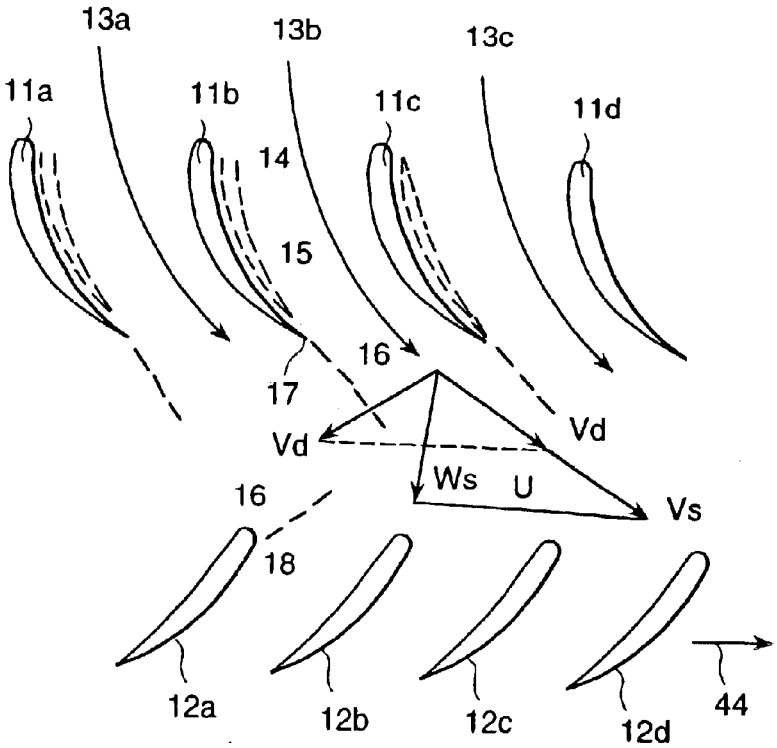
FIG. 11 is a view for explaining an erosion generation in a turbine stage.

FIG. 9 shows an entire diagram of a turbine bucket representing another embodiment of the present invention and FIG. 10 shows a detailed diagram of a shroud in FIG. 9. In FIGS. 9 and 10, 1 is a shroud of the following blade, 2 a shroud of the preceding blade, 1*a* and 2*a* are blade back side shroud portions, 1*b* and 2*b* are blade front side shroud portions, 20*x* is a blade cross section of the following blade at its blade tip portion, 20*y* is a cross section of the preceding blade at its blade tip portion and 40 is a turbine rotor disk portion. 5 is a contacting face where the blade back side shroud portion 1*a* of the following blade contacts each other with the blade front side 2*b* of the preceding blade, 8 is a portion near the blade front edge in the blade section at the blade tip of the shroud, 10 is a plane including the contacting face 5, and 51 respectively show upstream side edge faces of the respective shrouds 1 and 2.

Further, an arrow 44 shows the rotating direction of the bucket, and among two buckets which form an inter blade flow passage, the bucket located at the front side in the rotation direction is called as the preceding blade and the blade cross section at its blade tip portion is represented by 20*y*, and the bucket located at the rear side in the rotation direction is called as the following blade and the blade cross section at its blade tip portion is represented by 20*x*. 20*e* is a blade camber line of the following blade, 41 is a blade front edge of the following blade and 24 shows a blade rear edge of the following blade.

In FIG. 10, the mutual contacting face 5 of the shrouds 1 and 2 is constituted by the blade back side shroud portion 1*a* or 2*a* of a certain blade and the blade front side shroud portion 2*b* or 1*b* of the adjacent blade, and the plane 10 including the contacting face 5 is disposed at a position which never crosses to the blade section at the blade tip portion of the blade profile 20. Further, in FIGS. 9 and 10, in the shrouds 1 and 2 provided at the tip portions 3*b* of the blade profiles of the turbine buckets, when the blade camber lines 20*e* passing respectively through the blade section 20*x* at the blade tip portion of the following blade and the blade section 20*y* at the blade tip portion of the preceding blade are respectively extended, shroud regions in the respective shrouds 1 and 2 located at the blade back side with respect to the blade camber lines 200 constitute the blade back side shroud portions 1*a* and 2*a*, and shroud regions in the respective shrouds 1 and 2 located at the blade front side with respect to the blade camber lines 20*e* constitute the blade front side shroud portions 1*b* and 2*b*.

In the thus structured turbine bucket, when seen from the outer circumferential direction of the bucket, a face in the blade back side shroud 1*a* of the following blade including the contacting face 5 and opposing to the blade front side shroud portion 2*b* of the adjacent preceding blade is formed roughly in a convex shape with respect to the rotating direction of the bucket, and likely a face in the blade front side shroud 2*b* of the preceding blade including the contacting face 5 and opposing to the blade back side shroud portion 1*a* of the adjacent following blade is formed roughly in a concave shape with respect to the rotating direction of the bucket, and in the region of the respective opposing adjacent shroud portions of the buckets, a gap is formed at the region of the blade rear edge 47 side from the contacting face 5.

Further, among the opposing face of one of blade back side shroud portions 1*a* and 2*a* with one of the blade front side shroud portions 1*b* and 2*b* of the adjacent buckets, regions at the opposite side from the rotating direction 44 with respect to any plane 10 including the contacting face 5 are formed to have a gap each other. Further, at the near blade tip portion 8 of the blade section 20*x* at the blade top portion of the following blade (in particular at the back side near the blade front edge 42 in the blade back side shroud), formation of a recessed curved face such as like a cut-out when seen from the outer circumferential side of the steam turbine is prevented.

At top portion 41 of the convex portion is a local maximum portion with respect to the rotating direction of the bucket. A region from the top portion 41 of the convex portion near to the blade front edge 42 including the contacting face is formed at the side of the rotating direction from the blade front edge. At the side of the blade rear edge 47 from the top portion 41 of the convex portion a gap is formed with respect to the blade front side shroud portion 2*b* of the adjacent bucket.

In FIG. 10, when the turbine bucket is rotated, a twist return is caused in the arrowed direction 34 due to centrifugal force acting on the blades, and the blade back side shroud portion 1*a* of the following blade and the blade front side shroud portion 2*b* in the shrouds 1 and 2 secured at the tip portions of the respective blade profiles of the adjacent buckets are connected at the contacting face so as to restrict the blade twist return each other. At this moment, not only a face acting perpendicularly on the contacting face but also a shearing force acting along the contacting face 5 due to a centrifugal force directing outer circumferential side among that in the radial direction of the turbine rotor are induced. Further, through frictional slide phenomenon of the blade back side shroud portion 1*a* of the following blade and the blade front side shroud portion 2*b* of the preceding blade at the contacting face 5 due to blade vibration a shearing force along the contacting face 5 is caused. Because of these shearing forces, the end of the force train of the blade back side shroud portion 1*a* is directed from the contacting face toward the near blade tip portion 8 of the blade where the blade back side shroud is secured. For this reason, the near blade tip portion 8 as shown in FIG. 10 represents the portion where the stress concentrates most in the blade back side shroud portion 1*a*. In the steam turbine bucket of the present embodiment, the contacting face 5 between the blade back side shroud portion 1*a* of the following blade and the blade front side shroud 2*b* of the adjacent preceding blade is disposed in such a manner that the plane containing the contacting face 5 crosses a line component determined by extending the blade camber line 20*e* of the blade section at the blade tip portion of the following blade in the direction of the blade front edge 42 and an angle formed by the plane and the edge face 51 at the steam in upstream side of the blade back side shroud portion 1*a* of the following blade assumes an obtuse.

Thereby, since the configuration of the near blade tip portion 8 is a convex curved face. As shown in the drawing, the stress concentration can be reduced by its configuration. Further, since the location thereof is remote from a position near the blade back side shroud portion where erosion likely occurs, a negative synergetic effect when an erosion is caused at a portion subjected to the maximum stress on the blade back side shroud portion 1*a* can be extremely relaxed.

As has been explained above, for example, even in a bucket as shown in FIG. 9 in which the preceding blade (other blade) and the following blade (one blade) overlap near the tip portion 3*b* of the blade portion 3 when seen from the outer circumference (when seen in the direction of arrow 66), since a broad contacting face 5 with the blade front side shroud portion 2*b* of the adjacent preceding blade can be obtained, if a stress is caused at the contacting region because of a twist return of the blade due to centrifugal force, a stable contacting condition can be kept. Thereby, a stable stream turbine with no problems with regard to mechanical strength can be provided.

Now, erosion and fretting of which the shroud of the present embodiment resolves will be explained with reference to FIG. 11.

At first erosion phenomenon will be explained. In FIG. 11, 11*a*–11*d* show stator blades, 12*a*–12*d* buckets, 13*a*–13*c* steam flows, 14 water drop, 15 water film flow, 16 splashed water drop, 17 a stator blade rear edge and 18 a bucket back side portion. In thus constituted steam turbine stage, among wet steam flow which flows into the blade array of the stator blades 11*a*–11*d*, minute water drops flow along same loci as the steam flows 13*a*–13*c*. For example, at the stator blade 11*b*, a comparatively large water drop 14 deviates from the steam flow because of its inertia effect, hits onto the blade surface of the stator blades 11*a*–11*d* and deposits there to form the water film flow 15. When the water film flow reaches the stator blade rear edge 17, the water film flow is accelerated by the steam flows 13*a*–13*c* and is separated from the stator blade rear edge to form the splashed water drop. Flow velocity of the splashed water drop assumes extremely slow flow velocity Vd in comparison with flow velocity Vs of the steam flow, because the droplet diameter further increases than the initial droplet and the mass thereof increases. On the other hand, since the buckets are rotated at speed U, the steam flow assumes relative velocity Ws and the splashed water drop assumes relative velocity Wd on the velocity triangle. Therefore, the steam flow enters into the buckets 12*a*–12*d* under a condition with substantially no attack angle, in contrast thereto, the splashed droplets impinge at the back side of the bucket with a large attack angle, therefore, the bucket back side portion 18 is a portion where erosion phenomenon by water droplets can not be avoided. With regard to this phenomenon, a variety of measures have been proposed, however, until now such erosion can not be eliminated completely. Namely, such is one of problems which can not be avoided in a steam turbine.

For example, as shown in FIG. 10, during turbine rotation at the blade back side shroud portion 1*a* and the blade front side shroud portion 2*b* forces in mutually opposing directions are acted on the contacting face 5 so as to restrict the twist return acting on the bucket. In this instance, the maximum bending stress on the shroud exerted by the force restricting the twist return acting on the contacting face 5 is induced at the concave shaped cut-out portion which extends from the contacting face 5 toward the side of blade section 20*x* at the blade tip portion as shown by a dotted line and is formed at the blade back side and, in particular, at downstream side from the blade front edge portion 23 of the blade section 20*x* at the blade tip in the blade back side shroud portion, because the blade face representing the root of the shroud serves as a fixed end. For this reason, the above portion is a portion which has to pay careful attention at the time of design as a portion to which the most careful attention has to pay with regard to mechanical strength.

On the other hand, the shroud portion of the turbine bucket of the present embodiment does not include such concave shaped cut-out portion which extends from the contacting face toward the blade section as shown by the dotted line and is formed at the blade back side as in a conventional shroud as disclosed in JP-A-4-5402 (1992). Therefore, a possible influence affected by the water film flow can be suppressed. Further, since the above referred to concave shaped cut-out portion is located near the bucket back side portion, the splashed water droplets possibly impinge directly thereto, however, in the present embodiment there are no such possibilities.

Further, the turbine bucket of the present embodiment suppresses to become mechanically brittle due to erosion around the blade back side portion at the shroud root portion near the blade section 20*x* at the blade tip portion in the shroud as in the above referred to conventional art. In the blade back side shroud portion 1*a* even when a large bending stress acts around the root portion supporting the shroud 1, an influence of erosion can be avoided, thereby, a stable condition with regard to mechanical strength can be obtained.

Further, in the above referred to conventional art, since a gap is formed between the end face extending in upper left direction from the concave shaped cut-out portion and the adjacent shroud portion, the splashed water droplets as explained in connection with FIG. 11 remain in the gap as water. In such instance, when the contacting face of the shroud is positioned at downstream side from the blade front edge, the water in the gap flows toward downstream side in a form of water film to wet with high possibility the contacting face connecting the adjacent shroud. Under these circumstance, when the blades vibrate, a minute vibration is caused at the contacting face connecting the adjacent shroud, thus danger of fretting abrasion of the shroud contacting face containing much water will increase.

Contrary thereto, since the contacting face of the turbine bucket of the present embodiment positions at the upstream side from the blade front edge of the blade section 3*x* at the blade tip portion of the following blade as has been explained above, the influence of the water film flow is extremely limited. Namely, the steam turbine bucket of the present invention not only can relax the stress concentration and erosion but also can suppress generation of fretting abrasion due to minute vibration and frictional slide thereby of the contacting faces accompanying water droplets thereon which is caused by vibration of the turbine buckets.

As has been explained hitherto, a turbine bucket which relaxes stress concentration, suppresses erosion as well as relaxes influence of fretting abrasion by water or a highly reliable steam turbine using the same can be provided.

CHART 1

| Height = 0 (series of blade points on A section) | | | | | |
|---|---|---|---|---|---|
| | back side | | | front side | |
| No. | X | Y | No. | X | Y |
| 1 | 53.99 | −24.71 | 1 | 52.62 | −25.77 |
| 2 | 50.02 | −17.17 | 2 | 47.80 | −20.24 |
| 3 | 45.14 | −10.18 | 3 | 42.25 | −15.44 |
| 4 | 39.48 | −3.82 | 4 | 36.20 | −11.29 |
| 5 | 33.07 | 1.81 | 5 | 29.78 | −7.73 |
| 6 | 25.97 | 6.52 | 6 | 23.07 | −4.77 |
| 7 | 18.29 | 10.21 | 7 | 16.11 | −2.45 |
| 8 | 10.15 | 12.74 | 8 | 8.95 | −0.83 |
| 9 | 1.73 | 14.06 | 9 | 1.66 | −0.03 |
| 10 | −6.79 | 13.87 | 10 | −5.68 | −0.12 |
| 11 | −15.16 | 12.28 | 11 | −12.95 | −1.09 |
| 12 | −23.15 | 9.32 | 12 | −20.07 | −2.87 |
| 13 | −30.51 | 5.02 | 13 | −26.93 | −5.48 |
| 14 | −37.09 | −0.41 | 14 | −33.39 | −8.95 |
| 15 | −42.73 | −6.79 | 15 | −39.49 | −13.04 |
| 16 | −47.73 | −13.70 | 16 | −45.16 | −17.69 |
| 17 | −52.03 | −21.05 | 17 | −50.35 | −22.87 |

CHART 2

Height = 38 (series of blade points on B section)

| back side | | | front side | | |
|---|---|---|---|---|---|
| No. | X | Y | No. | X | Y |
| 1 | 52.43 | −21.70 | 1 | 51.11 | −22.82 |
| 2 | 48.76 | −14.19 | 2 | 46.67 | −17.10 |
| 3 | 43.96 | −7.34 | 3 | 41.19 | −12.37 |
| 4 | 38.16 | −1.33 | 4 | 35.07 | −8.49 |
| 5 | 31.56 | 3.80 | 5 | 28.58 | −5.28 |
| 6 | 24.37 | 8.05 | 6 | 21.79 | −2.78 |
| 7 | 16.65 | 11.25 | 7 | 14.74 | −1.10 |
| 8 | 8.50 | 13.13 | 8 | 7.56 | −0.19 |
| 9 | 0.16 | 13.65 | 9 | 0.32 | 0.05 |
| 10 | −8.13 | 12.67 | 10 | −6.90 | −0.52 |
| 11 | −16.17 | 10.36 | 11 | −14.00 | −1.93 |
| 12 | −23.76 | 6.87 | 12 | −20.90 | −4.13 |
| 13 | −30.70 | 2.21 | 13 | −27.50 | −7.11 |
| 14 | −36.86 | −3.44 | 14 | −33.70 | −10.85 |
| 15 | −42.24 | −9.83 | 15 | −39.44 | −15.26 |
| 16 | −47.01 | −16.69 | 16 | −44.74 | −20.19 |
| 17 | −51.12 | −23.97 | 17 | −49.55 | −25.60 |

CHART 3

Height = 70 (series of blade points on C section)

| back side | | | front side | | |
|---|---|---|---|---|---|
| No. | X | Y | No. | X | Y |
| 1 | 50.39 | −17.43 | 1 | 49.09 | −18.50 |
| 2 | 46.75 | −10.15 | 2 | 44.31 | −13.33 |
| 3 | 41.86 | −3.66 | 3 | 38.69 | −9.08 |
| 4 | 35.95 | 1.93 | 4 | 32.51 | −5.68 |
| 5 | 29.26 | 6.54 | 5 | 25.98 | −3.06 |
| 6 | 21.93 | 10.07 | 6 | 19.19 | −1.18 |
| 7 | 14.17 | 12.50 | 7 | 12.23 | −0.07 |
| 8 | 6.12 | 13.60 | 8 | 5.20 | 0.39 |
| 9 | −2.01 | 13.24 | 9 | −1.84 | 0.08 |
| 10 | −9.94 | 11.46 | 10 | −8.80 | −1.02 |
| 11 | −17.51 | 8.50 | 11 | −15.59 | −2.88 |
| 12 | −24.63 | 4.57 | 12 | −22.14 | −5.47 |
| 13 | −31.10 | −0.35 | 13 | −28.37 | −8.77 |
| 14 | −36.71 | −6.24 | 14 | −34.19 | −12.74 |
| 15 | −41.80 | −12.57 | 15 | −39.51 | −17.35 |
| 16 | −46.31 | −19.33 | 16 | −44.39 | −22.43 |
| 17 | −50.21 | −26.47 | 17 | −48.78 | −27.94 |

CHART 4

Height = 106 (series of blade points on D section)

| back side | | | front side | | |
|---|---|---|---|---|---|
| No. | X | Y | No. | X | Y |
| 1 | 48.84. | −14.22 | 1 | 47.62 | −15.33 |
| 2 | 45.04 | −7.24 | 2 | 42.70 | −10.44 |
| 3 | 39.98 | −1.13 | 3 | 36.97 | −6.55 |
| 4 | 33.93 | 4.03 | 4 | 30.70 | −3.59 |
| 5 | 27.17 | 8.18 | 5 | 24.12 | −1.42 |
| 6 | 19.83 | 11.20 | 6 | 17.34 | 0.03 |
| 7 | 12.10 | 13.00 | 7 | 10.46 | 0.77 |
| 8 | 4.16 | 13.30 | 8 | 3.53 | 0.83 |
| 9 | −3.69 | 12.19 | 9 | −3.36 | 0.11 |
| 10 | −11.29 | 9.89 | 10 | −10.12 | −1.42 |
| 11 | −18.46 | 6.49 | 11 | −16.65 | −3.73 |
| 12 | −25.09 | 2.12 | 12 | −22.87 | −6.78 |
| 13 | −31.11 | −3.05 | 13 | −28.72 | −10.50 |
| 14 | −36.37 | −8.99 | 14 | −34.16 | −14.79 |
| 15 | −41.17 | −15.32 | 15 | −39.16 | −19.59 |
| 16 | −45.44 | −22.01 | 16 | −43.72 | −24.80 |
| 17 | −49.16 | −29.01 | 17 | −47.82 | −30.39 |

CHART 5

Height = 138 (series of blade points on E section)

| back side | | | front side | | |
|---|---|---|---|---|---|
| No. | X | Y | No. | X | Y |
| 1 | 47.48 | −10.88 | 1 | 46.31 | −12.02 |
| 2 | 43.52 | −4.19 | 2 | 41.24 | −7.47 |
| 3 | 38.40 | 1.65 | 3 | 35.40 | −3.97 |
| 4 | 32.26 | 6.39 | 4 | 29.07 | −1.47 |
| 5 | 25.35 | 9.92 | 5 | 22.46 | 0.19 |
| 6 | 17.96 | 12.29 | 6 | 15.72 | 1.14 |
| 7 | 10.29 | 13.46 | 7 | 8.92 | 1.42 |
| 8 | 2.54 | 13.02 | 8 | 2.14 | 0.85 |
| 9 | −5.00 | 11.19 | 9 | −4.57 | −0.29 |
| 10 | −12.20 | 8.30 | 10 | −11.13 | −2.15 |
| 11 | −18.95 | 4.47 | 11 | −17.40 | −4.78 |
| 12 | −25.15 | −0.20 | 12 | −23.32 | −8.15 |
| 13 | −30.75 | −5.57 | 13 | −28.80 | −12.18 |
| 14 | −35.73 | −11.52 | 14 | −33.87 | −16.73 |
| 15 | −40.28 | −17.81 | 15 | −38.56 | −21.66 |
| 16 | −44.35 | −24.40 | 16 | −42.85 | −26.95 |
| 17 | −47.94 | −31.29 | 17 | −46.68 | −32.57 |

CHART 6

Height = 170 (series of blade points on F section)

| back side | | | front side | | |
|---|---|---|---|---|---|
| No. | X | Y | No. | X | Y |
| 1 | 46.46 | −8.07 | 1 | 45.38 | −9.28 |
| 2 | 42.08 | −1.90 | 2 | 40.10 | −5.14 |
| 3 | 36.54 | 3.23 | 3 | 34.14 | −2.07 |
| 4 | 30.18 | 7.33 | 4 | 27.77 | 0.01 |
| 5 | 23.27 | 10.41 | 5 | 21.19 | 1.27 |
| 6 | 15.97 | 12.37 | 6 | 14.51 | 1.84 |
| 7 | 8.44 | 13.03 | 7 | 7.81 | 1.79 |
| 8 | 0.94 | 12.07 | 8 | 1.16 | 0.96 |
| 9 | −6.29 | 9.87 | 9 | −5.36 | −0.57 |
| 10 | −13.10 | 6.60 | 10 | −11.65 | −2.87 |
| 11 | −19.48 | 2.54 | 11 | −17.62 | −5.92 |
| 12 | −25.32 | −2.26 | 12 | −23.21 | −9.61 |
| 13 | −30.53 | −7.74 | 13 | −28.41 | −13.83 |
| 14 | −35.32 | −13.58 | 14 | −33.26 | −18.46 |
| 15 | −39.66 | −19.77 | 15 | −37.75 | −23.43 |
| 16 | −43.52 | −26.27 | 16 | −41.87 | −28.72 |
| 17 | −46.88 | −33.05 | 17 | −45.58 | −34.30 |

CHART 7

Height = 215 (series of blade points on G section)

| back side | | | front side | | |
|---|---|---|---|---|---|
| No. | X | Y | No. | X | Y |
| 1 | 44.68 | −3.59 | 1 | 43.82 | −4.91 |
| 2 | 39.78 | 1.83 | 2 | 38.27 | −1.43 |
| 3 | 34.01 | 6.30 | 3 | 32.23 | 1.10 |
| 4 | 27.55 | 9.70 | 4 | 25.85 | 2.57 |
| 5 | 20.58 | 11.89 | 5 | 19.33 | 3.17 |
| 6 | 13.33 | 12.82 | 6 | 12.78 | 3.13 |
| 7 | 6.03 | 12.59 | 7 | 6.28 | 2.34 |
| 8 | −1.06 | 10.87 | 8 | −0.07 | 0.75 |
| 9 | −7.79 | 8.02 | 9 | −6.25 | −1.41 |
| 10 | −14.02 | 4.23 | 10 | −12.15 | −4.25 |
| 11 | −19.83 | −0.21 | 11 | −17.68 | −7.75 |
| 12 | −25.17 | −5.19 | 12 | −22.83 | −11.80 |
| 13 | −29.98 | −10.68 | 13 | −27.66 | −16.22 |
| 14 | −34.41 | −16.48 | 14 | −32.18 | −20.95 |
| 15 | −38.43 | −22.57 | 15 | −36.40 | −25.96 |
| 16 | −42.01 | −28.94 | 16 | −40.29 | −31.23 |
| 17 | −45.13 | −35.54 | 17 | −43.84 | −36.73 |

CHART 8

Height = 255 (series of blade points on H section)

| back side | | | front side | | |
|---|---|---|---|---|---|
| No. | X | Y | No. | X | Y |
| 1 | 42.87 | 1.04 | 1 | 42.19 | −0.36 |
| 2 | 37.78 | 5.95 | 2 | 36.56 | 2.68 |
| 3 | 31.80 | 9.72 | 3 | 30.40 | 4.36 |
| 4 | 25.19 | 12.25 | 4 | 24.04 | 5.05 |
| 5 | 18.23 | 13.49 | 5 | 17.65 | 4.98 |
| 6 | 11.16 | 13.47 | 6 | 11.31 | 4.21 |
| 7 | 4.18 | 12.32 | 7 | 5.08 | 2.79 |
| 8 | −2.45 | 9.86 | 8 | −0.90 | 0.55 |
| 9 | −8.62 | 6.41 | 9 | −6.70 | −2.15 |
| 10 | −14.38 | 2.30 | 10 | −12.15 | −5.47 |
| 11 | −19.60 | −2.45 | 11 | −17.20 | −9.39 |
| 12 | −24.36 | −7.69 | 12 | −21.89 | −13.73 |
| 13 | −28.80 | −13.19 | 13 | −26.34 | −18.32 |
| 14 | −32.88 | −18.96 | 14 | −30.54 | −23.13 |
| 15 | −36.59 | −24.98 | 15 | −34.49 | −28.15 |
| 16 | −39.91 | −31.22 | 16 | −38.16 | −33.38 |
| 17 | −42.84 | −37.65 | 17 | −41.55 | −38.80 |

CHART 9

Height 300 (series of blade points on I section)

| back side | | | 21/30 front side | | |
|---|---|---|---|---|---|
| No. | X | Y | No. | X | Y |
| 1 | 40.93 | 6.66 | 1 | 40.66 | 5.15 |
| 2 | 35.55 | 10.84 | 2 | 34.66 | 6.83 |
| 3 | 29.24 | 13.45 | 3 | 28.45 | 7.41 |
| 4 | 22.54 | 14.73 | 4 | 22.23 | 7.15 |
| 5 | 15.71 | 14.78 | 5 | 16.06 | 6.20 |
| 6 | 8.98 | 13.66 | 6 | 10.03 | 4.64 |
| 7 | 2.56 | 11.37 | 7 | 4.16 | 2.57 |
| 8 | −3.56 | 8.37 | 8 | −1.52 | 0.00 |
| 9 | −9.15 | 4.47 | 9 | −6.90 | −3.14 |
| 10 | −14.29 | −0.01 | 10 | −11.98 | −6.74 |
| 11 | −19.06 | −4.88 | 11 | −16.72 | −10.78 |
| 12 | −23.50 | −10.04 | 12 | −21.12 | −15.20 |
| 13 | −27.59 | −15.50 | 13 | −25.23 | −19.88 |
| 14 | −31.33 | −21.20 | 14 | −29.04 | −24.81 |
| 15 | −34.70 | −27.12 | 15 | −32.59 | −29.93 |
| 16 | −37.74 | −33.22 | 16 | −35.98 | −35.16 |
| 17 | −40.43 | −39.49 | 17 | −39.14 | −40.52 |

CHART 10

Height = 340 (series of blade points on J section)

| back side | | | front side | | |
|---|---|---|---|---|---|
| No. | X | Y | No. | X | Y |
| 1 | 37.69 | 13.97 | 1 | 37.80 | 12.45 |
| 2 | 31.64 | 16.22 | 2 | 31.79 | 12.04 |
| 3 | 25.21 | 16.73 | 3 | 25.85 | 11.01 |
| 4 | 18.76 | 16.27 | 4 | 20.02 | 9.47 |
| 5 | 12.44 | 14.91 | 5 | 14.34 | 7.48 |
| 6 | 6.37 | 12.70 | 6 | 8.79 | 5.11 |
| 7 | 0.55 | 9.86 | 7 | 3.42 | 2.39 |
| 8 | −4.92 | 6.42 | 8 | −1.69 | −0.80 |
| 9 | −9.96 | 2.37 | 9 | −6.66 | −4.22 |
| 10 | −14.57 | −2.17 | 10 | −11.36 | −8.00 |
| 11 | −18.80 | −7.07 | 11 | −15.71 | −12.16 |
| 12 | −22.72 | −12.21 | 12 | −19.74 | −16.65 |
| 13 | −26.37 | −17.55 | 13 | −23.50 | −21.35 |
| 14 | −29.70 | −23.10 | 14 | −27.08 | −26.21 |
| 15 | −32.68 | −28.84 | 15 | −30.43 | −31.22 |
| 16 | −35.38 | −34.72 | 16 | −33.57 | −36.36 |
| 17 | −37.79 | −40.72 | 17 | −36.49 | −41.64 |

CHART 11

Height = 380 (series of blade points on K section)

| back side | | | front side | | |
|---|---|---|---|---|---|
| No. | X | Y | No. | X | Y |
| 1 | 34.40 | 18.53 | 1 | 34.94 | 17.12 |
| 2 | 28.28 | 19.58 | 2 | 29.37 | 15.30 |
| 3 | 22.09 | 19.13 | 3 | 23.90 | 13.20 |
| 4 | 16.08 | 17.57 | 4 | 18.56 | 10.79 |
| 5 | 10.33 | 15.20 | 5 | 13.35 | 8.11 |
| 6 | 4.89 | 12.20 | 6 | 8.27 | 5.18 |
| 7 | −0.28 | 8.75 | 7 | 3.35 | 2.00 |
| 8 | −5.18 | 4.92 | 8 | −1.42 | −1.41 |
| 9 | −9.72 | 0.67 | 9 | −5.97 | −5.10 |
| 10 | −13.91 | −3.92 | 10 | −10.29 | −9.06 |
| 11 | −17.81 | −8.76 | 11 | −14.36 | −13.28 |
| 12 | −21.42 | −13.83 | 12 | −18.16 | −17.74 |
| 13 | −24.72 | −19.10 | 13 | −21.68 | −22.42 |
| 14 | −27.69 | −24.56 | 14 | −24.96 | −27.28 |
| 15 | −30.34 | −30.19 | 15 | −28.03 | −32.27 |
| 16 | −32.75 | −35.92 | 16 | −30.92 | −37.37 |
| 17 | −34.93 | −41.74 | 17 | −33.62 | −42.57 |

CHART 12

Height = 425 (series of blade points on L section)

| back side | | | front side | | |
|---|---|---|---|---|---|
| No. | X | Y | No. | X | Y |
| 1 | 30.60 | 22.64 | 1 | 31.33 | 21.37 |
| 2 | 24.70 | 22.25 | 2 | 26.65 | 18.23 |
| 3 | 19.03 | 20.65 | 3 | 21.91 | 15.18 |
| 4 | 13.62 | 18.27 | 4 | 17.13 | 12.20 |
| 5 | 8.51 | 15.32 | 5 | 12.42 | 9.11 |
| 6 | 3.72 | 11.88 | 6 | 7.84 | 5.82 |
| 7 | −0.75 | 8.02 | 7 | 3.45 | 2.29 |
| 8 | −4.92 | 3.85 | 8 | −0.74 | −1.47 |
| 9 | −8.90 | −0.52 | 9 | −4.72 | −5.46 |
| 10 | −12.47 | −5.21 | 10 | −8.55 | −9.59 |
| 11 | −15.76 | −10.11 | 11 | −12.18 | −13.90 |
| 12 | −18.83 | −15.15 | 12 | −15.57 | −18.40 |
| 13 | −21.69 | −20.31 | 13 | −18.73 | −23.07 |
| 14 | −24.33 | −25.59 | 14 | −21.68 | −27.87 |
| 15 | −26.73 | −30.98 | 15 | −24.46 | −32.77 |
| 16 | −28.90 | −36.47 | 16 | −27.08 | −37.76 |
| 17 | −30.82 | −42.05 | 17 | −29.54 | −42.83 |

CHART 13

Height = 470 (series of blade points on M section)

| back side | | | front side | | |
|---|---|---|---|---|---|
| No. | X | Y | No. | X | Y |
| 1 | 26.25 | 25.52 | 1 | 27.12 | 24.37 |
| 2 | 20.99 | 24.07 | 2 | 23.28 | 20.71 |
| 3 | 16.04 | 21.69 | 3 | 19.24 | 17.22 |
| 4 | 11.42 | 18.70 | 4 | 15.12 | 13.81 |
| 5 | 7.07 | 15.29 | 5 | 11.06 | 10.34 |
| 6 | 3.00 | 11.54 | 6 | 7.13 | 6.71 |
| 7 | −0.82 | 7.51 | 7 | 3.35 | 2.92 |
| 8 | −4.37 | 3.24 | 8 | −0.27 | −1.03 |
| 9 | −7.72 | −1.20 | 9 | −3.72 | −5.15 |
| 10 | −10.76 | −5.86 | 10 | −7.04 | −9.37 |
| 11 | −13.58 | −10.66 | 11 | −10.18 | −13.73 |
| 12 | −16.24 | −15.55 | 12 | −13.16 | −18.21 |
| 13 | −18.73 | −20.54 | 13 | −15.96 | −22.80 |
| 14 | −21.05 | −25.61 | 14 | −18.60 | −27.49 |
| 15 | −23.20 | −30.75 | 15 | −21.12 | −32.25 |
| 16 | −25.17 | −35.97 | 16 | −23.50 | −37.08 |
| 17 | −26.96 | −41.26 | 17 | −25.76 | −41.97 |

CHART 14

Height = 510 (series of blade points on N section)

| back side | | | front side | | |
|---|---|---|---|---|---|
| No. | X | Y | No. | X | Y |
| 1 | 22.39 | 28.09 | 1 | 23.38 | 27.05 |
| 2 | 17.67 | 25.69 | 2 | 20.28 | 22.91 |
| 3 | 13.38 | 22.60 | 3 | 16.87 | 19.03 |
| 4 | 9.44 | 19.07 | 4 | 13.34 | 15.25 |
| 5 | 5.78 | 15.25 | 5 | 9.86 | 11.43 |
| 6 | 2.34 | 11.23 | 6 | 6.50 | 7.51 |
| 7 | −0.89 | 7.04 | 7 | 3.25 | 3.48 |
| 8 | −3.90 | 2.69 | 8 | 0.14 | −0.64 |
| 9 | −6.68 | −1.82 | 9 | −2.84 | −4.86 |
| 10 | −9.25 | −6.44 | 10 | −5.69 | −9.17 |
| 11 | −11.66 | −11.15 | 11 | −8.41 | −13.57 |
| 12 | −13.94 | −15.92 | 12 | −11.01 | −18.03 |
| 13 | −16.11 | −20.75 | 13 | −13.50 | −22.56 |
| 14 | −18.15 | −25.63 | 14 | −15.88 | −27.15 |
| 15 | −20.07 | −30.56 | 15 | −18.15 | −31.79 |
| 16 | −21.87 | −35.54 | 16 | −20.33 | −36.48 |
| 17 | −23.54 | −40.56 | 17 | −22.39 | −41.21 |

CHART 15

Height = 550 (series of blade points on O section)

| back side | | | front side | | |
|---|---|---|---|---|---|
| No. | X | Y | No. | X | Y |
| 1 | 18.75 | 29.44 | 1 | 19.92 | 28.64 |
| 2 | 14.59 | 26.71 | 2 | 17.67 | 24.27 |
| 3 | 11.03 | 23.23 | 3 | 14.95 | 20.19 |
| 4 | 7.89 | 19.37 | 4 | 11.99 | 16.27 |
| 5 | 5.01 | 15.31 | 5 | 9.06 | 12.33 |
| 6 | 2.34 | 11.11 | 6 | 6.24 | 8.31 |
| 7 | −0.15 | 6.80 | 7 | 3.50 | 4.23 |
| 8 | −2.51 | 2.42 | 8 | 0.87 | 0.09 |
| 9 | −4.78 | −2.01 | 9 | −1.66 | −4.12 |
| 10 | −6.98 | −6.48 | 10 | −4.09 | −8.39 |
| 11 | −9.10 | −10.98 | 11 | −6.43 | −12.70 |
| 12 | −11.14 | −15.52 | 12 | −8.71 | −17.05 |
| 13 | −13.09 | −20.10 | 13 | −10.92 | −21.44 |
| 14 | −14.97 | −24.71 | 14 | −13.05 | −25.86 |
| 15 | −16.76 | −29.35 | 15 | −15.12 | −30.31 |
| 16 | −18.47 | −34.02 | 16 | −17.11 | −34.80 |
| 17 | −20.10 | −38.73 | 17 | −19.03 | −39.32 |

CHART 16

Height = 589 (series of blade points on P section)

| back side | | | front side | | |
|---|---|---|---|---|---|
| No. | X | Y | No. | X | Y |
| 1 | 17.30 | 29.70 | 1 | 18.44 | 28.95 |
| 2 | 13.58 | 26.72 | 2 | 16.86 | 24.50 |
| 3 | 10.45 | 23.13 | 3 | 14.48 | 20.42 |
| 4 | 7.64 | 19.28 | 4 | 11.80 | 16.53 |
| 5 | 5.04 | 15.28 | 5 | 9.12 | 12.65 |
| 6 | 2.63 | 11.17 | 6 | 6.52 | 8.71 |
| 7 | 0.36 | 6.98 | 7 | 4.00 | 4.72 |
| 8 | −1.79 | 2.73 | 8 | 1.55 | 0.68 |
| 9 | −3.90 | −1.55 | 9 | −0.81 | −3.41 |
| 10 | −5.95 | −5.85 | 10 | −3.09 | −7.54 |
| 11 | −7.93 | −10.18 | 11 | −5.31 | −11.71 |
| 12 | −9.86 | −14.54 | 12 | −7.47 | −15.90 |
| 13 | −11.72 | −18.93 | 13 | −9.59 | −20.13 |
| 14 | −13.51 | −23.34 | 14 | −11.64 | −24.38 |
| 15 | −15.24 | −27.78 | 15 | −13.64 | −28.65 |
| 16 | −16.90 | −32.25 | 16 | −15.57 | −32.96 |
| 17 | −18.49 | −36.74 | 17 | −17.44 | −37.30 |

CHART 17

Height = 625 (series of blade points on Q section)

| back side | | | front side | | |
|---|---|---|---|---|---|
| No. | X | Y | No. | X | Y |
| 1 | 16.24 | 30.11 | 1 | 17.35 | 29.20 |
| 2 | 12.85 | 27.01 | 2 | 16.11 | 24.82 |
| 3 | 9.96 | 23.44 | 3 | 14.04 | 20.78 |
| 4 | 7.44 | 19.61 | 4 | 11.63 | 16.92 |
| 5 | 5.16 | 15.62 | 5 | 9.17 | 13.09 |
| 6 | 3.01 | 11.56 | 6 | 6.78 | 9.22 |
| 7 | 0.94 | 7.46 | 7 | 4.46 | 5.31 |
| 8 | −1.05 | 3.33 | 8 | 2.18 | 1.38 |
| 9 | −3.00 | −0.83 | 9 | −0.03 | −2.60 |
| 10 | −4.93 | −5.00 | 10 | −2.17 | −6.61 |
| 11 | −6.80 | −9.19 | 11 | −4.27 | −10.65 |
| 12 | −8.63 | −13.40 | 12 | −6.33 | −14.70 |
| 13 | −10.41 | −17.63 | 13 | −8.35 | −18.77 |
| 14 | −12.14 | −21.88 | 14 | −10.34 | −22.87 |
| 15 | −13.82 | −26.15 | 15 | −12.27 | −26.98 |
| 16 | −15.45 | −30.45 | 16 | −14.15 | −31.13 |
| 17 | −17.01 | −34.76 | 17 | −15.97 | −35.29 |

CHART 18

Height = 660.4 (series of blade points on R section)

| back side | | | front side | | |
|---|---|---|---|---|---|
| No. | X | Y | No. | X | Y |
| 1 | 15.29 | 30.21 | 1 | 16.38 | 29.26 |
| 2 | 12.06 | 27.20 | 2 | 15.33 | 25.01 |
| 3 | 9.39 | 23.68 | 3 | 13.53 | 21.03 |
| 4 | 7.18 | 19.86 | 4 | 11.39 | 17.22 |
| 5 | 5.23 | 15.89 | 5 | 9.17 | 13.45 |
| 6 | 3.37 | 11.89 | 6 | 6.99 | 9.66 |
| 7 | 1.48 | 7.90 | 7 | 4.88 | 5.83 |
| 8 | −0.33 | 3.88 | 8 | 2.77 | 2.00 |
| 9 | −2.14 | −0.15 | 9 | 0.71 | −1.85 |
| 10 | −3.94 | −4.19 | 10 | −1.29 | −5.74 |
| 11 | −5.71 | −8.23 | 11 | −3.27 | −9.64 |
| 12 | −7.44 | −12.29 | 12 | −5.22 | −13.55 |
| 13 | −9.14 | −16.37 | 13 | −7.16 | −17.47 |
| 14 | −10.80 | −20.46 | 14 | −9.07 | −21.41 |
| 15 | −12.44 | −24.56 | 15 | −10.94 | −25.36 |
| 16 | −14.02 | −28.68 | 16 | −12.76 | −29.33 |
| 17 | −15.55 | −32.82 | 17 | −14.54 | −33.33 |

CHART 19

Height = 0 (series of blade points on A section)

| back side | | | front side | | |
|---|---|---|---|---|---|
| No. | X | Y | No. | X | Y |
| 1 | 53.99 | −24.79 | 1 | 51.87 | −26.29 |
| 2 | 50.71 | −16.86 | 2 | 47.39 | −20.60 |
| 3 | 45.93 | −9.73 | 3 | 42.02 | −15.74 |
| 4 | 40.22 | −3.32 | 4 | 36.04 | −11.64 |
| 5 | 33.75 | 2.32 | 5 | 29.68 | −8.18 |
| 6 | 26.58 | 7.05 | 6 | 23.04 | −5.29 |
| 7 | 18.83 | 10.75 | 7 | 16.16 | −3.02 |
| 8 | 10.63 | 13.28 | 8 | 9.09 | −1.45 |
| 9 | 2.14 | 14.59 | 9 | 1.88 | −0.70 |
| 10 | −6.44 | 14.38 | 10 | −5.36 | −0.82 |
| 11 | −14.87 | 12.76 | 11 | −12.54 | −1.79 |
| 12 | −22.92 | 9.77 | 12 | −19.56 | −3.58 |
| 13 | −30.33 | 5.43 | 13 | −26.32 | −6.17 |
| 14 | −36.95 | −0.04 | 14 | −32.71 | −9.60 |
| 15 | −42.63 | −6.48 | 15 | −38.72 | −13.64 |
| 16 | −47.46 | −13.43 | 16 | −44.51 | −18.24 |
| 17 | −51.73 | −20.85 | 17 | −49.97 | −23.33 |

CHART 20

Height = 38 (series of blade points on B section)

| back side | | | front side | | |
|---|---|---|---|---|---|
| No. | X | Y | No. | X | Y |
| 1 | 52.92 | −21.61 | 1 | 50.93 | −23.30 |
| 2 | 49.19 | −13.95 | 2 | 46.31 | −17.45 |
| 3 | 44.35 | −7.04 | 3 | 40.90 | −12.79 |
| 4 | 38.49 | −0.97 | 4 | 34.82 | −8.94 |
| 5 | 31.84 | 4.20 | 5 | 28.38 | −5.75 |
| 6 | 24.59 | 8.49 | 6 | 21.64 | −3.27 |
| 7 | 16.80 | 11.72 | 7 | 14.65 | −1.61 |
| 8 | 8.58 | 13.61 | 8 | 7.52 | −0.71 |
| 9 | 0.15 | 14.13 | 9 | 0.33 | −0.46 |
| 10 | −8.24 | 13.14 | 10 | −6.83 | −1.03 |
| 11 | −16.34 | 10.82 | 11 | −13.87 | −2.43 |
| 12 | −24.01 | 7.29 | 12 | −20.72 | −4.61 |
| 13 | −31.01 | 2.59 | 13 | −27.27 | −7.56 |
| 14 | −37.22 | −3.10 | 14 | −33.41 | −11.28 |
| 15 | −42.64 | −9.54 | 15 | −39.12 | −15.65 |
| 16 | −47.38 | −16.44 | 16 | −44.54 | −20.55 |
| 17 | −51.36 | −23.75 | 17 | −49.67 | −25.93 |

CHART 21

Height = 70 (series of blade points on C section)

| back side | | | front side | | |
|---|---|---|---|---|---|
| No. | X | Y | No. | X | Y |
| 1 | 50.76 | −17.39 | 1 | 48.96 | −18.88 |
| 2 | 47.08 | −9.97 | 2 | 44.05 | −13.63 |
| 3 | 42.14 | −3.42 | 3 | 38.49 | −9.41 |
| 4 | 36.19 | 2.21 | 4 | 32.35 | −6.04 |
| 5 | 29.45 | 6.85 | 5 | 25.85 | −3.43 |
| 6 | 22.07 | 10.41 | 6 | 19.11 | −1.57 |
| 7 | 14.26 | 12.85 | 7 | 12.19 | −0.46 |
| 8 | 6.13 | 13.96 | 8 | 5.20 | −0.01 |
| 9 | −2.06 | 13.60 | 9 | −1.80 | −0.32 |
| 10 | −10.05 | 11.80 | 10 | −8.72 | −1.41 |
| 11 | −17.67 | 8.83 | 11 | −15.47 | −3.26 |
| 12 | −24.84 | 4.87 | 12 | −21.99 | −5.83 |
| 13 | −31.36 | −0.08 | 13 | −28.17 | −9.11 |
| 14 | −36.99 | −6.01 | 14 | −33.96 | −13.06 |
| 15 | −42.11 | −12.37 | 15 | −39.27 | −17.64 |
| 16 | −46.54 | −19.15 | 16 | −44.26 | −22.70 |
| 17 | −50.35 | −26.32 | 17 | −48.79 | −28.18 |

CHART 22

Height = 106 (series of blade points on D section)

| back side | | | front side | | |
|---|---|---|---|---|---|
| No. | X | Y | No. | X | Y |
| 1 | 49.13 | −14.16 | 1 | 47.52 | −15.62 |
| 2 | 45.29 | −7.07 | 2 | 42.51 | −10.67 |
| 3 | 40.19 | −0.92 | 3 | 36.82 | −6.81 |
| 4 | 34.11 | 4.27 | 4 | 30.59 | −3.87 |
| 5 | 27.30 | 8.44 | 5 | 24.04 | −1.71 |
| 6 | 19.92 | 11.48 | 6 | 17.30 | −0.27 |
| 7 | 12.14 | 13.29 | 7 | 10.44 | 0.47 |
| 8 | 4.15 | 13.60 | 8 | 3.54 | 0.53 |
| 9 | −3.76 | 12.48 | 9 | −3.31 | −0.19 |
| 10 | −11.40 | 10.17 | 10 | −10.04 | −1.71 |
| 11 | −18.61 | 6.75 | 11 | −16.54 | −4.01 |
| 12 | −25.28 | 2.36 | 12 | −22.73 | −7.04 |
| 13 | −31.32 | −2.84 | 13 | −28.54 | −10.75 |
| 14 | −36.61 | −8.80 | 14 | −33.96 | −15.02 |
| 15 | −41.41 | −15.15 | 15 | −38.94 | −19.80 |
| 16 | −45.70 | −21.86 | 16 | −43.51 | −24.99 |
| 17 | −49.31 | −28.89 | 17 | −47.71 | −30.56 |

CHART 23

Height = 138 (series of blade points on E section)

| back side | | | front side | | |
|---|---|---|---|---|---|
| No. | X | Y | No. | X | Y |
| 1 | 47.67 | −10.85 | 1 | 46.26 | −12.23 |
| 2 | 43.68 | −4.10 | 2 | 41.12 | −7.66 |
| 3 | 38.54 | 1.77 | 3 | 35.31 | −4.17 |
| 4 | 32.37 | 6.53 | 4 | 29.01 | −1.68 |
| 5 | 25.43 | 10.08 | 5 | 22.42 | −0.03 |
| 6 | 18.01 | 12.46 | 6 | 15.70 | 0.92 |
| 7 | 10.30 | 13.63 | 7 | 8.92 | 1.20 |
| 8 | 2.51 | 13.19 | 8 | 2.16 | 0.63 |
| 9 | −5.06 | 11.36 | 9 | −4.53 | −0.51 |
| 10 | −12.29 | 8.46 | 10 | −11.06 | −2.36 |
| 11 | −19.06 | 4.61 | 11 | −17.31 | −4.98 |
| 12 | −25.28 | −0.07 | 12 | −23.21 | −8.34 |
| 13 | −30.89 | −5.46 | 13 | −28.68 | −12.36 |
| 14 | −35.88 | −11.42 | 14 | −33.73 | −16.89 |
| 15 | −40.44 | −17.72 | 15 | −38.41 | −21.81 |
| 16 | −44.53 | −24.33 | 16 | −42.69 | −27.09 |
| 17 | −48.12 | −31.22 | 17 | −46.56 | −32.70 |

CHART 24

Height = 170 (series of blade points on F section)

| back side | | | front side | | |
|---|---|---|---|---|---|
| No. | X | Y | No. | X | Y |
| 1 | 46.60 | −8.04 | 1 | 45.34 | −9.43 |
| 2 | 42.19 | −1.83 | 2 | 40.02 | −5.28 |
| 3 | 36.62 | 3.32 | 3 | 34.09 | −2.23 |
| 4 | 30.25 | 7.44 | 4 | 27.74 | −0.15 |
| 5 | 23.32 | 10.52 | 5 | 21.17 | 1.11 |
| 6 | 16.00 | 12.48 | 6 | 14.51 | 1.68 |
| 7 | 8.44 | 13.15 | 7 | 7.82 | 1.63 |
| 8 | 0.91 | 12.18 | 8 | 1.19 | 0.80 |
| 9 | −6.34 | 9.97 | 9 | −5.32 | −0.73 |
| 10 | −13.17 | 6.70 | 10 | −11.60 | −3.02 |
| 11 | −19.57 | 2.63 | 11 | −17.55 | −6.06 |
| 12 | −25.42 | −2.18 | 12 | −23.13 | −9.74 |
| 13 | −30.64 | −7.67 | 13 | −28.32 | −13.96 |
| 14 | −35.44 | −13.52 | 14 | −33.16 | −18.58 |
| 15 | −39.78 | −19.72 | 15 | −37.65 | −23.54 |
| 16 | −43.64 | −26.23 | 16 | −41.76 | −28.82 |
| 17 | −47.01 | −33.01 | 17 | −45.46 | −34.39 |

INDUSTRIAL FEASIBILITY

The turbine bucket of the present invention is used in an electric power generation field in which an electric power is produced.

What is claimed is:

1. A stream turbine bucket, characterized in that the blade length of the steam turbine bucket is 660 mm, the steam turbine bucket is provided with a shroud which is formed integral with the blade portion at a blade tip portion of the bucket, the shroud is connected through contact with a like shroud formed for an adjacent steam turbine blade, and the blade is configured into a structure having a vibration characteristic with no resonance under a use condition in a rated r.p.m. of the bucket without providing a coupling member at the intermediate of the steam turbine blade.

* * * * *